US010149530B1

(12) United States Patent
Grayson

(10) Patent No.: US 10,149,530 B1
(45) Date of Patent: Dec. 11, 2018

(54) MULTI-PURPOSE MAT FOR OUTDOOR ACTIVITIES

(71) Applicant: Michael P. Grayson, Commerce City, CO (US)

(72) Inventor: Michael P. Grayson, Commerce City, CO (US)

( * ) Notice: Subject to any disclaimer, the term of this patent is extended or adjusted under 35 U.S.C. 154(b) by 0 days.

(21) Appl. No.: 15/497,090

(22) Filed: Apr. 25, 2017

(51) Int. Cl.

| | |
|---|---|
| ***A41D 15/04*** | (2006.01) |
| ***A45F 4/14*** | (2006.01) |
| ***E04H 15/30*** | (2006.01) |
| ***E04H 15/46*** | (2006.01) |
| ***E04H 15/02*** | (2006.01) |
| *A42B 1/04* | (2006.01) |

(52) U.S. Cl.
CPC ..... *A45F 4/14* (2013.01); *E04H 15/02* (2013.01); *E04H 15/30* (2013.01); *E04H 15/46* (2013.01); *A42B 1/048* (2013.01); *Y10T 428/24008* (2015.01)

(58) Field of Classification Search
CPC . Y10T 428/24008; A41D 15/04; E04H 15/44; E04H 15/46; E04H 15/54; E04H 15/64; E04H 15/30; A45F 4/04; A45F 4/14
See application file for complete search history.

(56) References Cited

U.S. PATENT DOCUMENTS

2013/0174826 A1* 7/2013 Faherty ..... F41B 5/1496 124/88

* cited by examiner

*Primary Examiner* — Alexander S Thomas
(74) *Attorney, Agent, or Firm* — Edwin H. Crabtree; Ramon L. Pizarro

(57) ABSTRACT

A multi-purpose mat which includes a four-sided mat cover made of heavy water proof fabric. The mat cover includes a plurality of spaced apart metal snaps or similar types of fasteners. The fasteners are used for attaching one mat cover to another for forming a privacy shield, a tent or like outdoor structures. The mat cover includes corner pockets. The pockets are used for receiving opposite ends of two telescoping poles. The poles are pinned together to form an "X" shaped configuration. The poles are used to hold the mat cover in tension. On two of the sides of the mat cover are arm sleeves. A user of the multi-purpose mat can place his or her arms through the arm sleeves and wear the mat cover as a wrap. Also, one end of the mat cover includes a removable hood.

20 Claims, 3 Drawing Sheets

MULTI-PURPOSE MAT FOR OUTDOOR ACTIVITIES

BACKGROUND OF THE INVENTION

(a) Field of the Invention

This invention relates to an outdoor or indoor mat and more particularly, but not by way of limitation, to a multi-purpose mat that can be used as a vehicle cover or tarp, a vehicle seat cover, a tent, a privacy shield for an outside toilet, a water proof wrap, a car seat cover, and similar uses during outdoor activities.

(b) Discussion of Prior Art

Heretofore, various types of ground covers have been used in a number of ways when camping, hiking, picnics and other types of outdoor occasions. The subject invention provides a heavy duty, water proof or water resistant, multi-purpose mat or tarp that can be used in a variety of ways.

SUMMARY OF THE INVENTION

In view of the foregoing, it is a primary objective of the subject invention to provide one or more multi-purpose mats that can be snapped together for providing a cover when camping, hiking, picnic or other outdoor activities. Also, the mat is water proof and can be used as a cover for a motorcycle and other vehicles for protection when changing a tire or working on or under the vehicle.

Another object of the invention is two mats can be joined together for making a tent or an outdoor privacy shield for going to the bathroom.

Still another object of the mat is to use it as a raincoat. The mat can include a hood for head protection from rain, wind, and cold.

The subject invention includes a four-sided, square or rectangular shaped, mat cover, made of heavy water proof fabric, such as nylon or similar material. The mat cover includes a plurality of spaced apart metal snaps or similar types of fasteners. The metal snaps are used for attaching one mat cover to another for forming a privacy shield, tent or like outdoor structure. Four corners of the mat cover include triangular shaped pockets. The pockets are used for receiving opposite ends of two telescoping poles. The poles are pinned together to form an "X" shaped configuration. The poles are used to hold the mat cover rigid and in tension. On two of the sides of the mat cover are arm sleeves. A user of the multi-purpose mat can place his or her arms through the arm sleeves and wear the mat cover as a wrap. Also, one end of the mat cover includes a removable hood for placing over the mat user's head during rain, wind or cold weather. The hood can also be used to cover a motorcycle helmet mounted on a motorcycle and other applications.

These and other objects of the present invention will become apparent to those familiar with mats or tarps used outdoors when reviewing the following detailed description, showing novel construction, combination, and elements as herein described, and more particularly defined by the claims, it being understood that changes in the embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments in the present invention according to the best modes presently devised for the practical application of the subject multi-purpose mat, and in which.

DETAILED DESCRIPTION OF THE PREFERRED EMBODIMENTS

Figure 1:
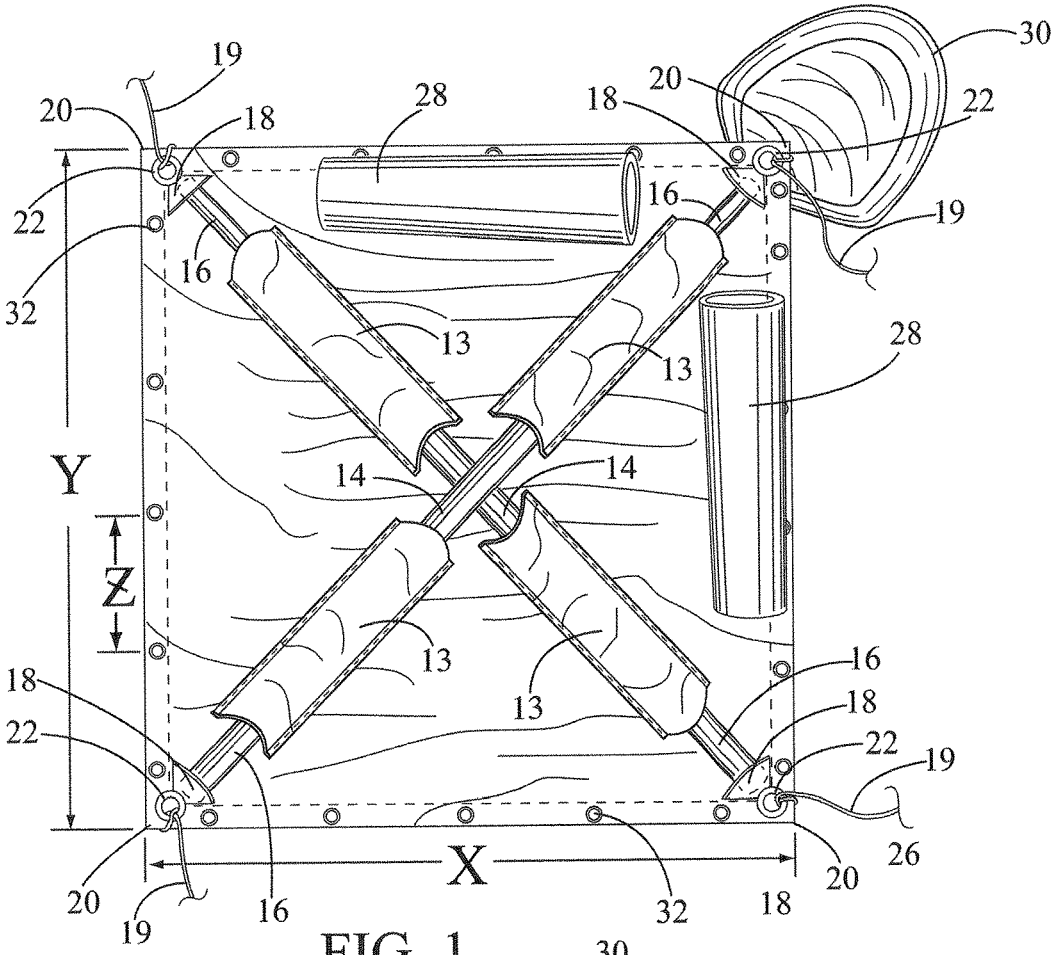
FIG. 1 is a front view of the multi-purpose mat with a pair of X-shaped, telescoping poles used to hold the mat cover rigid and in a tension.

In FIG. 1, a front view of the multi-purpose mat is shown having a general reference numeral 10. The mat 10 includes a mat cover 12, made of a heavy water proof fabric, made of nylon or similar material. The mat cover 12 has a width "X" in a range of 4 to 8 feet and a length "Y" in a range of 4 to 8 feet. The cover 12 can have a square or rectangular configuration. The mat 10 includes a pair of telescoping poles 14, pined together to form an "X" shaped configuration. The poles 14, when telescoped outwardly, are used to hold the mat cover 12 rigid and in tension. Opposite ends 16 of the poles 14 are received in pockets 18, attached to the four corners 20 of the mat cover 12. The mat 10 also includes pole covers 13 for covering the poles 14 and holding the poles in place on the mat.

Figure 2:
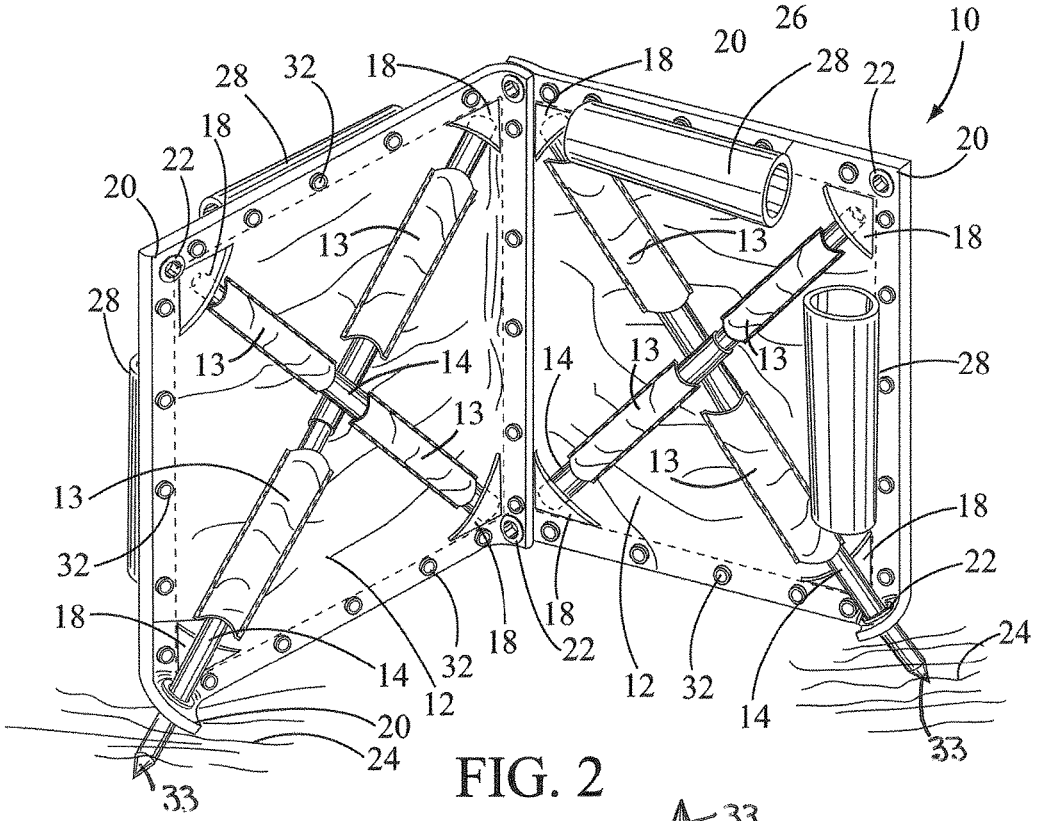
FIG. 2 is a perspective view of two of the multi-purpose mats snapped together and held vertically.

The four corners 20 of the mat cover 12 can also include metal grommets 22. The grommets 22 can be sized to allow the ends 16 of the poles 14 to be received therethrough and inserted into a ground surface 24, as shown in FIG. 2, for forming different types of temporary structures. In this example, the end 16 of the poles 14 can be place on top of the pockets 18 and then inserted through the grommets. Also, the grommets 22 can be used for receiving a portion of a tie down string 19. The tie down string 19 can be used to tie the multi-purpose mat 10 to a tree, a fence, a wall, or a side of a vehicle to create a protective cover and the like.

Figure 1A:
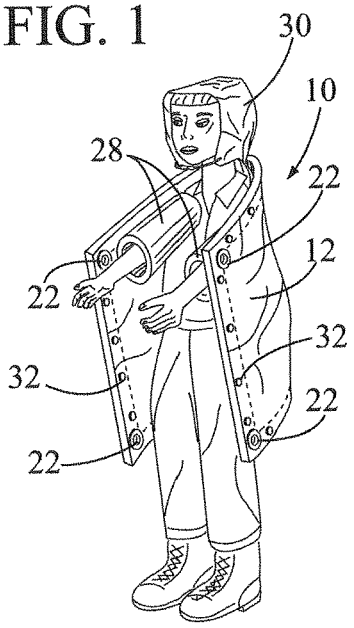
FIG. 1A is a perspective view of the multi-propose mat used as a raincoat by a user of the invention.

Also shown in FIG. 1 is a pair of tapered arm sleeves 28. A user of the subject multi-purpose mat 10 can inserted his or her arms trough the sleeves 28 and wrapping a portion of the mat cover 12 around the user's shoulders. At this time, the mat cover 12 can be used as a rain coat and protection against wind and cold. This feature of the multi-purpose mat 10 is shown in FIG. 1A.

The mat cover 12 also includes a removable hood 30 at one corner of the mat cover, for placing over the user's head for weather protection. Also, the hood 30 can be used to cover a motorcycle helmet mounted on top of a motorcycle and similar applications.

Figure 3:
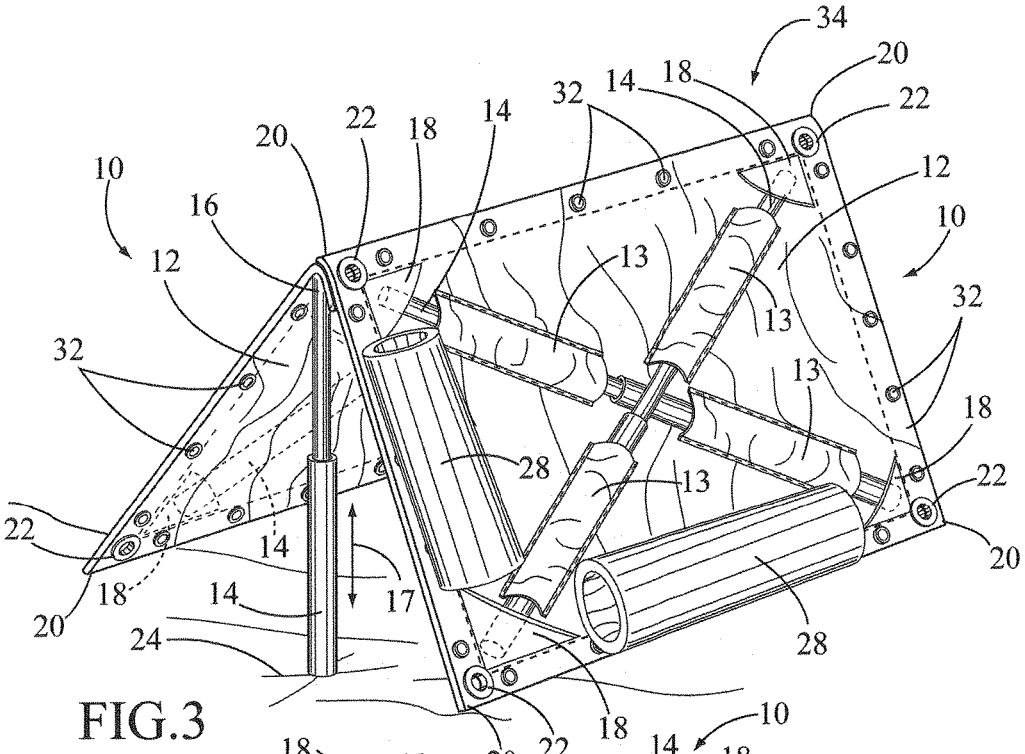
FIG. 3 is a perspective view of two multi-purpose mats used to form a tent with telescoping tent poles.
Figure 4:
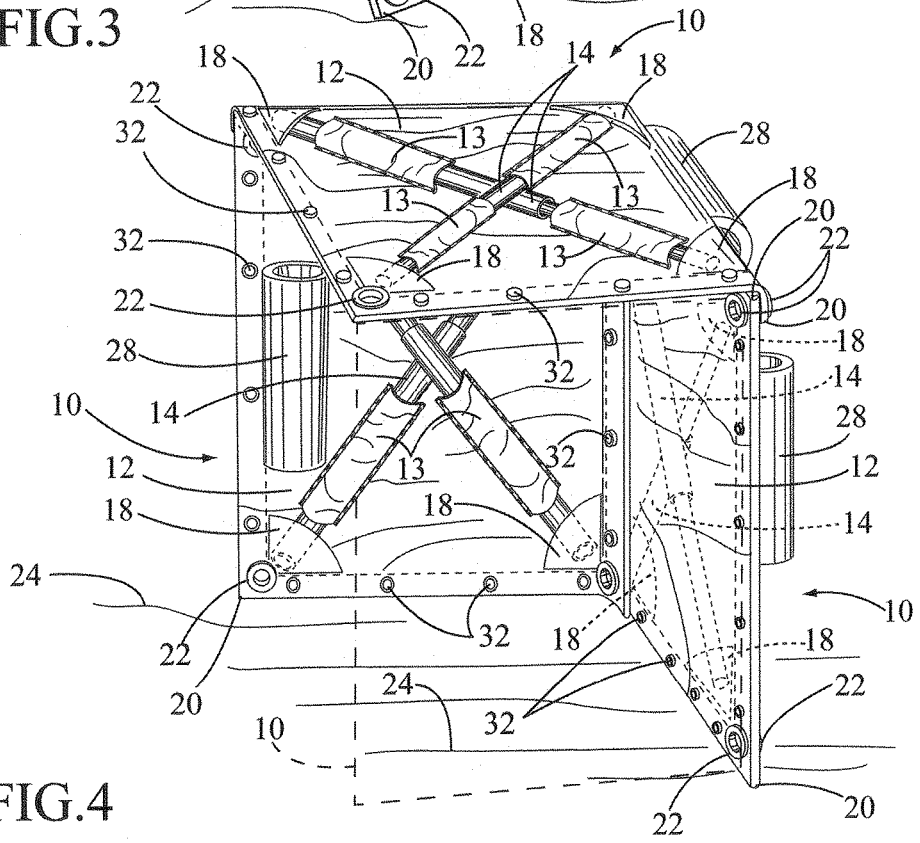
FIG. 4 is another perspective view of the two multi-purpose mats used to form a privacy shield for going to the bathroom outdoors.

The mat cover 12 also includes a plurality of spaced apart metal snaps 32 along the four sides of the cover. The snaps 32 are spaced apart a distance "Z", in a range of 6 to 12 inches. The snaps are use to attached one mat cover 12 to another, as shown in FIGS. 2-4. While the metal snaps are mentioned, any similar type of fastener, such as Velcro, zippers, buttons, can be used equally well for attaching the mat covers 12 together.

In FIG. 2, a perspective view of two of the multi-purpose mats 10 are shown snapped together and held vertically. As mentioned above, pointed ends 33 of the poles 14 can be placed over the pockets 18 and through the grommets 22 into the ground surface 24. This feature allows the poles 14 to be used for holding the mats 10 in an upright, vertical position, as shown in this drawing.

Figure 2A:
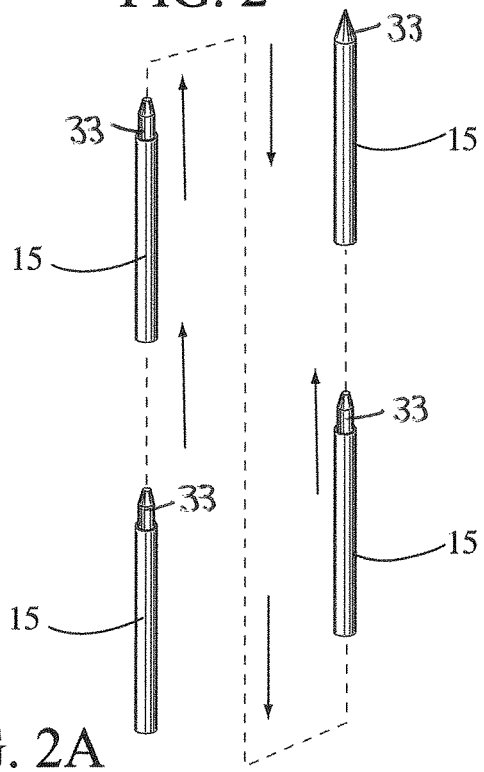
FIG. 2A is a front view of a pair to pointed stake poles, which a used as an alternative to the telescoping poles shown in the drawings.

In FIG. 2A, a front view of two pair of tapered stacking poles 15 are shown. The poles 15 can be attached to each other, end to end. The pointed end 33 of the poles 15 can be used for inserting into the ground surface 24. This type of pole can be used as an alternative to the telescoping poles 14.

In FIG. 3, a perspective view of two multi-purpose mats 10, attached together, are illustrated and used to form a tent, having a general reference numeral 34. In this example, a pair of the tent poles 14 can be used, with the end 16 of the poles inserted to a selected grommet 22 in the top of the mat covers 12 for holding the tent 34 in an upright position.

In FIG. 4, another perspective view of the two multi-purpose mats 10, attached together, is shown to form an upright privacy shield, and used when going to the bathroom outdoors. The privacy shield has a general reference numeral 36.

While FIGS. 1-4 illustrate the structure and function of the subject multi-purpose mat 10, it can be appreciated that one, two, three, four or more mats 10 can be attached to each other for forming various types of temporary structures, a play house for children, used as tarps or drapes in a garage or warehouse, used as an outdoor ground cover, used as a protective car seat cover, and the like and used outdoors or if need be, indoors.

While the invention has been particularly shown, described and illustrated in detail with reference to the preferred embodiments and modifications thereof, it should be understood by those skilled in the art that equivalent changes in form and detail may be made therein without departing from the true spirit and scope of the invention as claimed except as precluded by the prior art.

The embodiments of the invention for which as exclusive privilege and property right is claimed are defined as follows:

1. A multi-purpose mat for various outdoor uses, the mat comprising:

an angular four-sided mat cover made of a water proof fabric;

a plurality of spaced apart fasteners disposed along four sides of the mat cover, the fasteners used for attaching one mat to another mat;

four corner pockets disposed in four corners of the mat cover; and a pair of poles, the poles pinned together to form an "X" shaped configuration, opposite ends of the poles are received in the four corner pockets.

2. The multi-purpose mat as described in claim 1 wherein the poles are telescoping poles, when the ends of the poles are placed in the four corner pockets, the poles are extended outwardly for holding the mat cover in tension.

3. The multi-purpose mat as described in claim 1 further including a pair of arm sleeves attached to sides of the mat cover, wherein a user of the mat can place his or her arms through the arm sleeves and wear the mat cover as a wrap.

4. The multi-purpose mat as described in claim 1 further including a removable hood attached to one of the corners of the mat cover and adapted for placing over a head of a user of the mat.

5. The multi-purpose mat as described in claim 1 wherein the four corners of the mat cover include metal grommets.

6. The multi-purpose mat as described in claim 1 wherein the spaced apart fasteners along the sides of the mat cover are snap fasteners.

7. The multi-purpose mat as described in claim 6 wherein the mat cover has a length in a range of 4 to 8 feet.

8. The multi-purpose mat as described in claim 6 wherein the fasteners are spaced apart on the sides of the mat cover in a range of 6 to 12 inches.

9. A multi-purpose mat for various outdoor and indoor uses, the mat comprising:

an angular shaped four-sided mat cover made of a water proof fabric;

a plurality of spaced apart fasteners disposed along four sides of the mat cover, the fasteners used for attaching one mat to another mat;

four triangular-shaped corner pockets disposed in four corners of the mat cover; and a pair of telescoping poles, the poles pinned together to form an "X" shaped configuration, opposite ends of the poles are received in the four corner pockets for holding the mat cover rigid and in tension.

10. The multi-purpose mat as described in claim 9 further including a pair of tapered arm sleeves attached to sides of the mat cover, wherein a user of the mat can place his or her arms through the arm sleeves and wear the mat cover as a wrap.

11. The multi-purpose mat as described in claim 9 further including a removable hood attached to one of the corners of the mat cover for placing over a head of a user of the mat.

12. The multi-purpose mat as described in claim 9 wherein the four corners of the mat cover include metal grommets, the metal grommets dimensioned for receiving a portion of the ends of the poles therethrough.

13. The multi-purpose mat as described in claim 9 wherein the mat cover has a width in a range of 4 to 8 feet.

14. A plurality of multi-purpose mats for various outdoor and indoor uses, the mats comprising:

an angular shaped four-sided mat cover made of a water proof fabric;

a plurality of spaced apart fasteners disposed along four sides of the mat cover, the fasteners used for attaching two or more mats together;

four triangular-shaped corner pockets disposed in four corners of the mat cover;

a pair of telescoping poles, the poles pinned together to form an "X" shaped configuration, opposite ends of the poles are received in the four corner pockets for holding the mat cover rigid and in tension; and pole covers attached to the mat cover, the pole covers received around the telescoping poles for holding the poles in place on the mat cover.

15. The multi-purpose mat as described in claim 14 further including a pair of tapered arm sleeves attached to sides of the mat cover, wherein a user of the mat can place his or her arms through the arm sleeves and wear the mat cover as a wrap.

16. The multi-purpose mat as described in claim 14 further including a removable hood attached to one of the corners of the mat cover for placing over a head of a user of the mat.

17. The multi-purpose mat as described in claim 14 wherein the four corners of the mat cover include metal grommets, the metal grommets dimensioned for receiving a portion of the ends of the poles therethrough.

18. The multi-purpose mat as described in claim 14 wherein the mat cover has a width in a range of 4 to 8 feet.

19. The multi-purpose mat as described in claim 14 wherein the mat cover has a length in a range of 4 to 8 feet.

20. The multi-purpose mat as described in claim 14 wherein the fasteners are spaced apart on the sides of the mat cover in a range of 6 to 12 inches.

* * * * *